US005803779A

United States Patent [19]

Horton, III

[11] Patent Number: 5,803,779

[45] Date of Patent: Sep. 8, 1998

[54] DYNAMICALLY POSITIONED LOADING BUOY

[75] Inventor: Edward E. Horton, III, Houston, Tex.

[73] Assignee: Deep Oil Technology, Incorporated, Houston, Tex.

[21] Appl. No.: 805,811

[22] Filed: Feb. 26, 1997

[51] Int. Cl.[6] ..... B63B 22/02

[52] U.S. Cl. ..... 441/4; 114/230

[58] Field of Search ..... 114/230, 293, 114/144 B; 441/3–5; 166/352–355

[56] References Cited

U.S. PATENT DOCUMENTS

| | | | |
|---|---|---|---|
| 3,080,583 | 3/1967 | Fuller | 441/4 |
| 3,327,668 | 6/1967 | Von Schultz | 114/144 B |
| 3,595,195 | 7/1971 | Van Eck | 441/4 |
| 4,205,379 | 5/1980 | Fox et al. | 114/144 B |
| 4,371,037 | 2/1983 | Arnaudeau | 114/230 |
| 4,441,448 | 4/1984 | Hillberg | 114/230 |

*Primary Examiner*—Ed L. Swinehart
*Attorney, Agent, or Firm*—Robert J. Edwards; D. Neil LaHaye

[57] ABSTRACT

A dynamically positioned loading buoy for transferring liquid from an offshore structure to a tanker. The loading buoy is a floating hull. The hull is provided with thrusters that are used to position the loading buoy and tanker in a safe position relative to the offshore structure. The use of thrusters on the loading buoy eliminates the need for anchors and mooring lines for the loading buoy. The transfer hose used to transfer oil between the offshore structure and the loading buoy may be stored on the loading buoy or the offshore structure. The transfer hose used to transfer oil between the loading buoy and the tanker is stored on a reel on the loading buoy.

3 Claims, 2 Drawing Sheets

DYNAMICALLY POSITIONED LOADING BUOY

BACKGROUND OF THE INVENTION

1. Field of the Invention

The invention is generally related to the transfer of oil from an offshore structure to a tanker and more particularly to a buoy used for mooring the tanker in position a distance away from the offshore structure.

2. General Background

In the production of oil from offshore wells, the oil is typically either stored at the production site or delivered via a pipeline to a different site offshore or to an onshore site for storage. Oil that is stored at a site offshore must eventually be loaded onto a tanker for shipment to an onshore storage and production facility.

Tankers which are currently used for these operations are equipped with bow and stern thrusters which give them adequate maneuvering capability to come up to the loading buoy and maintain a safe distance from the storage platform. This additional equipment increases the cost of the tanker and thus makes it uneconomical for conventional cargo operations. The result being that it becomes a "dedicated shuttle tanker", limited to transporting the oil from the platform to a nearby shore station. One of the purposes of this invention is to provide the loading buoy with maneuvering capability so that oil can be safely loaded into "tankers of opportunity" and transported long distances to offloading terminals. The concept means that there is less reliance on the skill and capability of the tanker and its captain, and shifts that reliance to the maneuvering capability of the buoy and its well experienced captain. The analogy is similar to the rationale of a harbor pilot taken on board to assist the captain in safely entering a harbor.

Tankers are normally moored to a loading buoy that is permanently anchored in place a distance from the offshore structure to allow the tanker to weathervane in response to changing environmental conditions. This loading buoy is typically anchored as much as five thousand feet from the offshore structure. Such a distance has been necessary to provide a margin of safety to prevent the tanker from damaging the offshore structure in the event that the mooring line between the tanker and loading buoy should break or slip loose.

The permanently moored loading buoy has several disadvantages that are particularly related to cost. The most obvious disadvantage is that the position of the loading buoy relative to the storage platform is fixed. Thus, the tanker must often take a position where the environmental forces might force the tanker into a collision with the platform if the hawser line should break. Keep in mind that during the loading process, the tanker has no steerage way and thus is totally dependent on the buoy for holding position. At such a distance from the offshore structure, the length of the transfer hose between the structure and the buoy presents a substantial cost. As the water gets deeper, it becomes progressively more expensive to set anchors on the sea floor and run mooring lines from the anchors to the buoy.

SUMMARY OF THE INVENTION

The invention addresses the above disadvantages. What is provided is a dynamically positioned loading buoy. The loading buoy is in the shape of a floating hull having a number of thrusters that are used to position the loading buoy and tanker in a safe position relative to the offshore structure. The provision of thrusters on the loading buoy eliminates the need for anchors and mooring lines for the loading buoy, and thus allows the buoy itself to move relative to the storage platform so that the tanker is in the safest position as the environmental forces shift (i.e., the buoy controls the position of the tanker).

Further, by utilizing information obtained from an array of current, wind and wave instruments, the desired position of the buoy can be anticipated, and anticipatory steps can be taken by the buoy to ensure that the tanker is in a safe position relative to the storage platform.

The transfer hose used to transfer oil between the offshore structure and the loading buoy may be stored on the loading buoy or the offshore structure or portions of each on both vessels. The transfer hose used to transfer oil between the loading buoy and the tanker is preferably stored on a reel on the loading buoy.

BRIEF DESCRIPTION OF THE DRAWINGS

For a further understanding of the nature and objects of the present invention reference should be had to the following description, taken in conjunction with the accompanying drawings in which like parts are given like reference numerals, and wherein.

DETAILED DESCRIPTION OF THE PREFERRED EMBODIMENT

Figure 1:
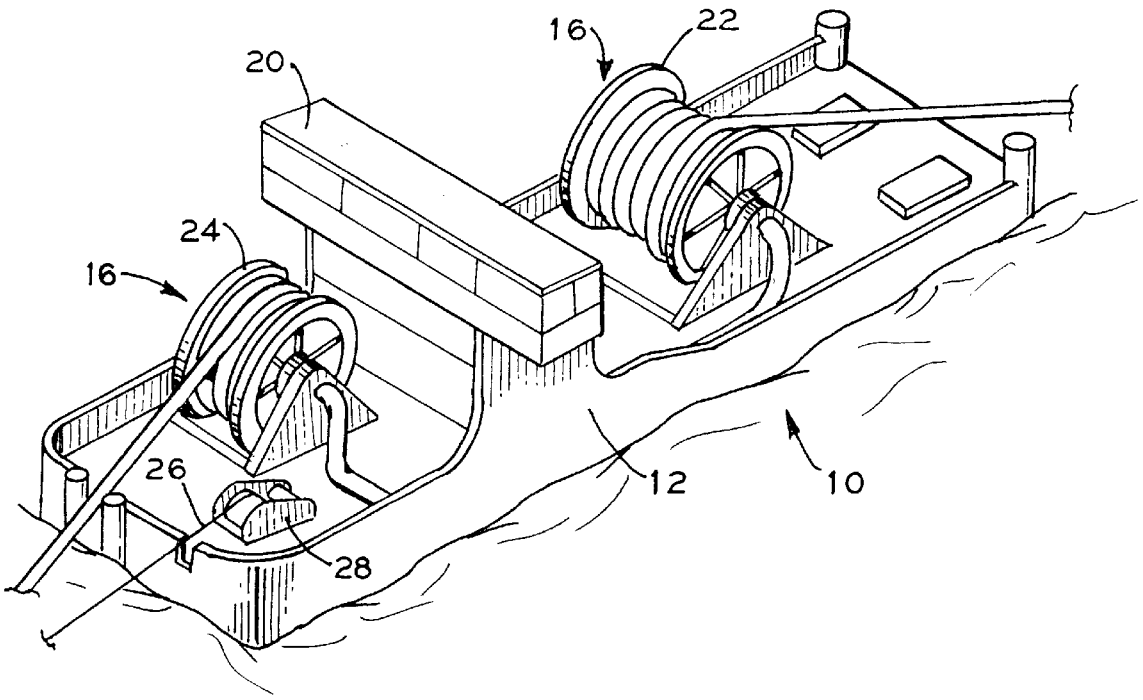
FIG. 1 is a perspective view of the invention.
Figure 2:
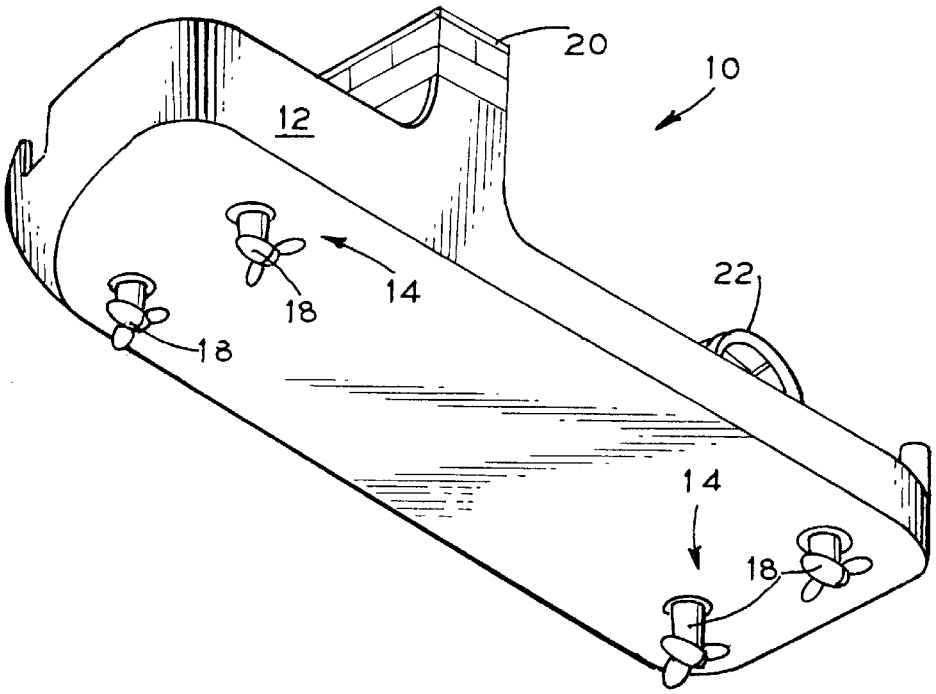
FIG. 2 is a perspective bottom view of the invention.

Referring to the drawings, it is seen in FIG. 1 and 2 that the invention is generally indicated by the numeral 10. Dynamically positioned loading buoy 10 is comprised of a floating hull 12, propulsion means 14, and liquid transfer means 16 for transferring liquid from an offshore structure to a tanker.

In the preferred embodiment, the hull 12 has a barge-like hull with a spoon bow, a length of approximately two hundred feet and a beam of sixty to ninety feet. It should be noted that other hull shapes and sizes are possible. The shape and size of the hull 12 are governed more by the space required for the liquid transfer means 16 and for a power source for the propulsion means 14, as well as the environmental conditions in which the buoy 12 will be operating. A control area 20 is provided for personnel to view operations and control the position of the hull 12 using the propulsion means 14.

The hull 12 is also provided with a hawser 26 (or mooring line 26) and hawser winch 28 for connecting the hull 12 to the tanker during loading operations. This is an important feature because the tanker is pulling against the buoy through the hawser line. Also note that the hawser winch is on board the dynamically positioned buoy. This is in keeping with the concept of being able to offload oil to "tankers of opportunity" which have minimal maneuvering capabilities.

As best seen in FIG. 2, the propulsion means 14 may be comprised of a plurality of thrusters 18 spaced apart and positioned adjacent the four corners of the hull 12. A power source, not shown, for the thrusters 18 is housed in the hull 12.

The liquid transfer means 16 is comprised of two separate supplies of hose 22, 24 for transferring liquid from the offshore structure to the tanker. The necessary piping and valves used to provide fluid communication between the two hose supplies is not illustrated or described as it is well known in the industry.

The first hose supply 22 is used to transfer liquid between the offshore structure and the loading buoy 10. The first hose supply 22 may be stored on the offshore structure or it may be stored on a reel on the hull 12.

The second hose supply 24 is used to transfer liquid between the loading buoy 10 and the tanker. The second hose supply 24 is preferably of sufficient length to allow a midship loading whether the loading buoy 10 has the mooring line 26 connected to the bow or stern of the tanker.

Figure 3:
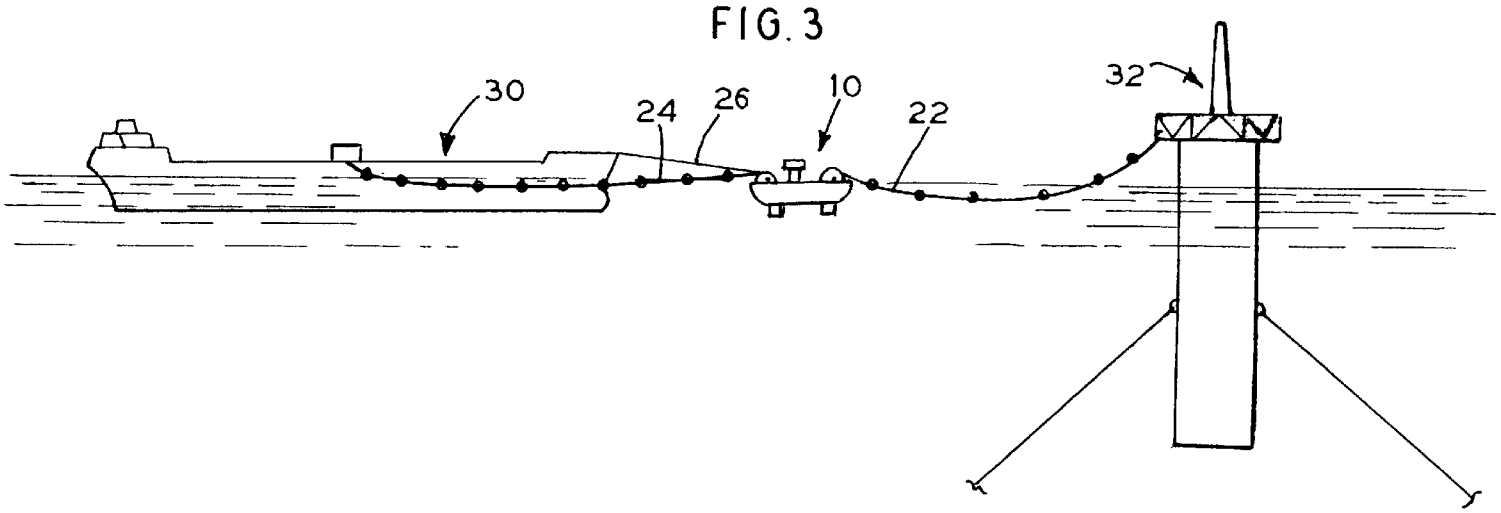
FIG. 3 is a side elevation view that illustrates the invention in position between a tanker and an offshore structure.
Figure 4:
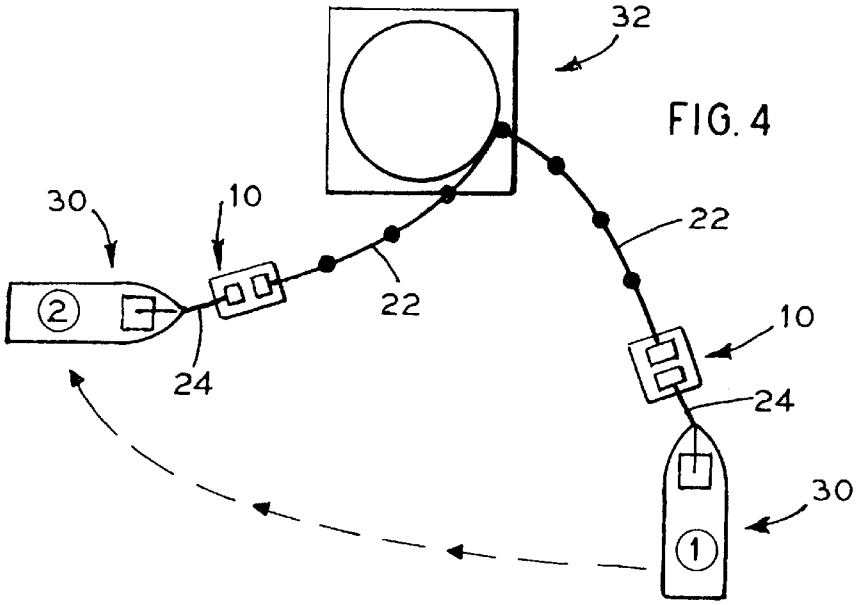
FIG. 4 illustrates the operation of the invention in a change of direction of environmental forces.

FIG. 3 and 4 illustrate the loading buoy 10 in operation. FIG. 3 is a side schematic view that illustrates the general positioning of the loading buoy 10 and tanker 30 relative to the offshore structure 32. In operation, the tanker 30 approaches the offshore structure 32 from downwind and on an offset track using minimum steerage way. At a selected distance from the offshore structure, the tanker 30 picks up the mooring line 26 from the loading buoy 10 and reverses turns on the tanker propeller to develop minimum sternway until the mooring line 26 is taut. The loading buoy is now capable of controlling the position of the tanker 30 using the thrusters 18. Depending on the magnitude of the environmental force acting on the tanker 30, the tanker may stop its propeller turns or maintain some stern thrust to pull against the loading buoy 10. The advantage of the loading buoy 10 is that it has adequate power to control the tanker's position. Next, the loading buoy 10 moves the tanker 30 into a position where the offshore structure is within reach of the first supply hose 22. This hose 22 is moved between the loading buoy 10 and offshore structure 32 by a messenger line and connected to the discharge fitting on the offshore structure. At the same time, the second hose 24 is brought to the tanker 30 and connected to the tanker's loading fitting. After the connections are checked, the loading operation can commence and liquid can then be pumped from the offshore structure 32 to the tanker 30 through the loading buoy 10.

FIG. 4 illustrates the situation where the environmental forces change during the loading operation. The tanker 30, with the numeral 1 inside, represents the position of the tanker 30 during the initial part of the operations. In this position, the environmental forces are essentially directed at the bow of the tanker 30. As the direction of the environmental forces change, the thrusters 18 on the loading buoy 10 are used to reposition the loading buoy 10 and the tanker 30 such that the environmental forces are still essentially directed at the bow of the tanker 30. This is illustrated by the tanker having the numeral 2 therein.

The ability of the loading buoy to reposition both the loading buoy and tanker prevents the tanker from swinging, or weathervaning, around the loading buoy into dangerous proximity to the offshore structure 32. This allows the loading buoy 10 to be positioned much closer to the offshore structure 32, as little as five hundred to one thousand feet, as opposed to the five thousand foot distance usually required for a fixed position loading buoy.

It should be noted that the above operational description also applies to mooring the stern of the tanker 30 to the loading buoy 10 and is not limited to mooring to the bow of the tanker 30. In the case of mooring the loading buoy 10 to the stern of the tanker 30, the stern would be facing into the environmental forces. In either position the thrust developed by the tanker's propellers is directed away from the offshore structure 32. Naturally, the environmental forces would be monitored constantly with adjustments made by the operator of the loading buoy 10 as necessary.

Although the transfer hoses are illustrated as floating hoses, submerged hoses may also be used. Also, a floating offshore structure 32 is shown for illustrative purposes only. The dynamically positioned loading buoy may be used in conjunction with any type of offshore structure.

The inventive loading buoy provides several advantages over fixed position loading buoys. The dynamic positioning capability of the loading buoy 10 eliminates the need for a shuttle tanker and allows the use of a large "tanker of opportunity". The safety of loading oil onto a tanker will be enhanced, particularly where a large "tanker of opportunity" will be used. The capital investment of the off loading system is relatively low since it is limited to the dynamically positioned loading buoy and does not require modification of tankers or, alternatively installing a deep water loading buoy with its attendant anchor line and long transfer hose connecting back to the offshore structure.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A loading buoy for transferring liquid from an offshore structure to a tanker, comprising:

a. a floating hull;

b. a hawser line having a first end attached to said hull and a second end adapted to be attached to the tanker during liquid transfer operations;

c. propulsion means provided on said hull for actively maintaining said hull and the tanker, during liquid transfer operations, at a predetermined distance from the offshore structure and in a position such that environmental forces will move said hull and the tanker away from the offshore structure in the event said hawser line fails; and d. liquid transfer means provided on said hull for transferring liquid from the offshore structure to the tanker.

2. The loading buoy of claim 1, wherein said propulsion means comprises dynamic positioning thrusters.

3. The loading buoy of claim 1, wherein said liquid transfer means includes a hose for connection between said floating hull and the tanker.

* * * * *